US006086227A

United States Patent [19]

O'Connell et al.

[11] Patent Number: 6,086,227

[45] Date of Patent: Jul. 11, 2000

[54] LAMP WITH FACETED REFLECTOR AND SPIRAL LENS

[75] Inventors: William C. O'Connell, Lexington; Joseph P. Gallant, Winchester, both of Ky.

[73] Assignee: Osram Sylvania Inc., Danvers, Mass.

[21] Appl. No.: 09/151,542

[22] Filed: Sep. 11, 1998

[51] Int. Cl.[7] ..... F21V 7/00

[52] U.S. Cl. ..... 362/297; 362/309; 362/329; 362/346

[58] Field of Search ..... 362/297, 310, 362/346, 516, 518, 296, 308, 327, 329, 522, 309

[56] References Cited

U.S. PATENT DOCUMENTS 5,272,408 12/1993 Levin et al. ..... 362/297
5,720,123 2/1998 Taylor ..... 362/135

*Primary Examiner*—Thomas M. Sember
*Attorney, Agent, or Firm*—William E. Meyer

[57] ABSTRACT

A lamp with a faceted spiral reflector and a spiral faceted lens is disclosed. The lamp with spiral reflector and spiral lens yields a smooth circular beam pattern with a perceived sharp beam edge. The source image is well dispersed, and the beam illumination is visually smooth.

7 Claims, 6 Drawing Sheets

LAMP WITH FACETED REFLECTOR AND SPIRAL LENS

TECHNICAL FIELD

The invention relates to electric lamps and particularly to reflector lamps. More particularly the invention is concerned with a reflector and lens combination to produce a controlled beam pattern.

BACKGROUND ART

Reflector lamps need to accommodate both beam spread and beam esthetics. Commonly, the user seeks a beam with a spread angle that fits a particular need. Beams are basically formed by the reflector contour. Typically a parabola of rotation is used to provide a tightly collimated, parallel beam. A perfectly smooth reflector however projects images of the underlying light source. The filament or arc image is then seen as a light pattern projected onto the object being lit. This undesirable result is usually overcome with lenticules on the lens that break up the source image. Lenticules are also used to spread the light, for example from a parallel beam to a cone with a chosen spread angle. Lenticules are commonly arranged in patterns, but they can form overlapping light patterns that result in streaks of light or dark. For example, a typical hexagonally closed packed lenticule pattern results in a hexagonal beam pattern as shown in FIG. 1 (video scanned image). Such patterns may be acceptable for lighting a driveway, but it is objectionable in consumer displays, or similar applications where esthetics are important. In general, source image dispersion leads to a more diffuse spot, and less light on the subject area. There is then a need for a PAR lamp with a well defined spot, and a dispersed source image.

Beam esthetics are difficult to define. This is due to the active response of the human eye and brain to integrate the actual light pattern into a perceived pattern. The perception process depends in part on the color, intensity, contrast and other of factors of the actual light in the beam, and also on how much stray light exists outside the perceived beam. Beam esthetics can be affected by such variables as focus of the light source in the reflector, defects on the lenticules and the characteristics of visual perception. The human eye, for example, acts to enhance edges for contrast, so when presented with a sharp change in light intensity, the perceived beam edge is enhanced. This process unfortunately can enhance beam defects that may appear insignificant when measured with a meter. This process also results in optical illusions. For example in a beam with a sharp cut off, there can be a perception of a bright beam center surrounded by an even brighter ring that is surrounded in turn by a dark ring surrounded by a less dark exterior region. The bright ring and the dark ring are illusory, and cannot be identified with actual meter readings. The collimated light of a PAR lamp not only produces sharp cutoffs when spread through a spherical lenticule, it can also show manufacturing defects that can occur in the lenticule. Any structured deviation from the spherical contour can be visible in the beam if a parabolic reflector is used. There is then a need for a reflector lamp with good beam spread, a well defined spot that is evenly lit with good diffusion of source images, and little or no illusory image effects.

DISCLOSURE OF THE INVENTION

A reflector lamp providing an improved beam pattern may be formed with an electric light source, a reflector with a wall defining a cavity, an axis, and a rim defining an opening. The light source is positioned in the cavity between the wall and the opening along the axis. The reflector is further formed to have a reflective surface facing the light source shaped and positioned with respect to the light source to provide a beam of light, and the reflective surface including a number of facets positioned around the axis whereby a cross section perpendicular to the axis through the facets provides N facet sections, wherein N is equal to or greater than 16 and less than or equal to 64. The lamp further includes a lens formed as a light transmissive plate shaped to mate with the reflector along the rim, the lens having a multiplicity lenticules distributed thereon, the lenticules positioned to form a plural number of M spiral arm patterns extending from the lens center to the lens rim, wherein N is greater than M.

BEST MODE FOR CARRYING OUT THE INVENTION

Figure 1:
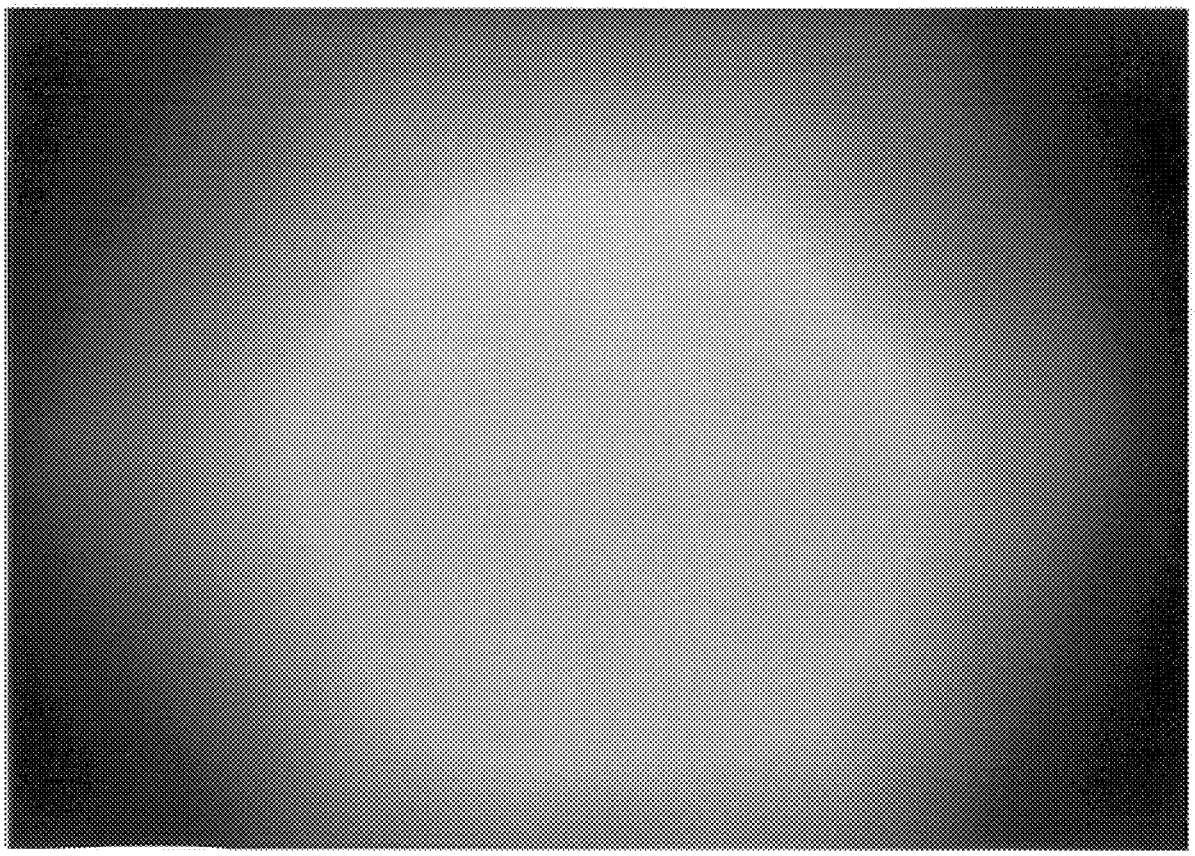
FIG. 1 PRIOR ART
FIG. 1 shows a prior art beam pattern from a prior art PAR lamp.
Figure 2:
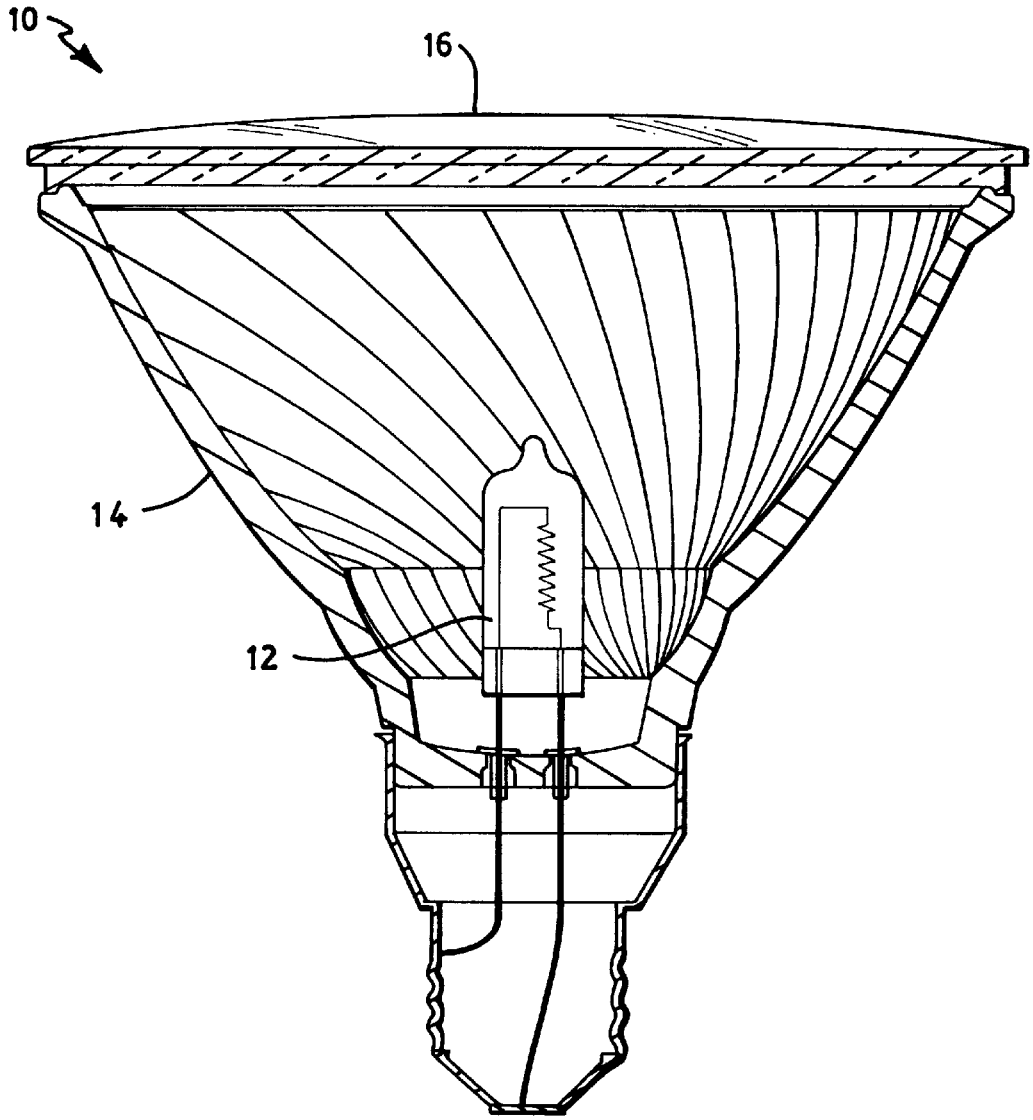
FIG. 2 shows a cross sectional view of a preferred embodiment of a lamp with spiral reflector and lens.

FIG. 2 shows a cross sectional view of a preferred embodiment of a lamp with spiral reflector and lens. The preferred embodiment of lamp 10 includes a light source 12, a reflector 14 with a pattern of spiraling facets, and a lens 16 with a pattern of spiraling lenticules. The light source 12 may be made out of tungsten halogen or arc discharge, but any compact, electric light source 12 is acceptable. The preferred light source 12 has the general form of a single ended press sealed tungsten halogen bulb. Doubled ended and other forms may be used.

Figure 3:
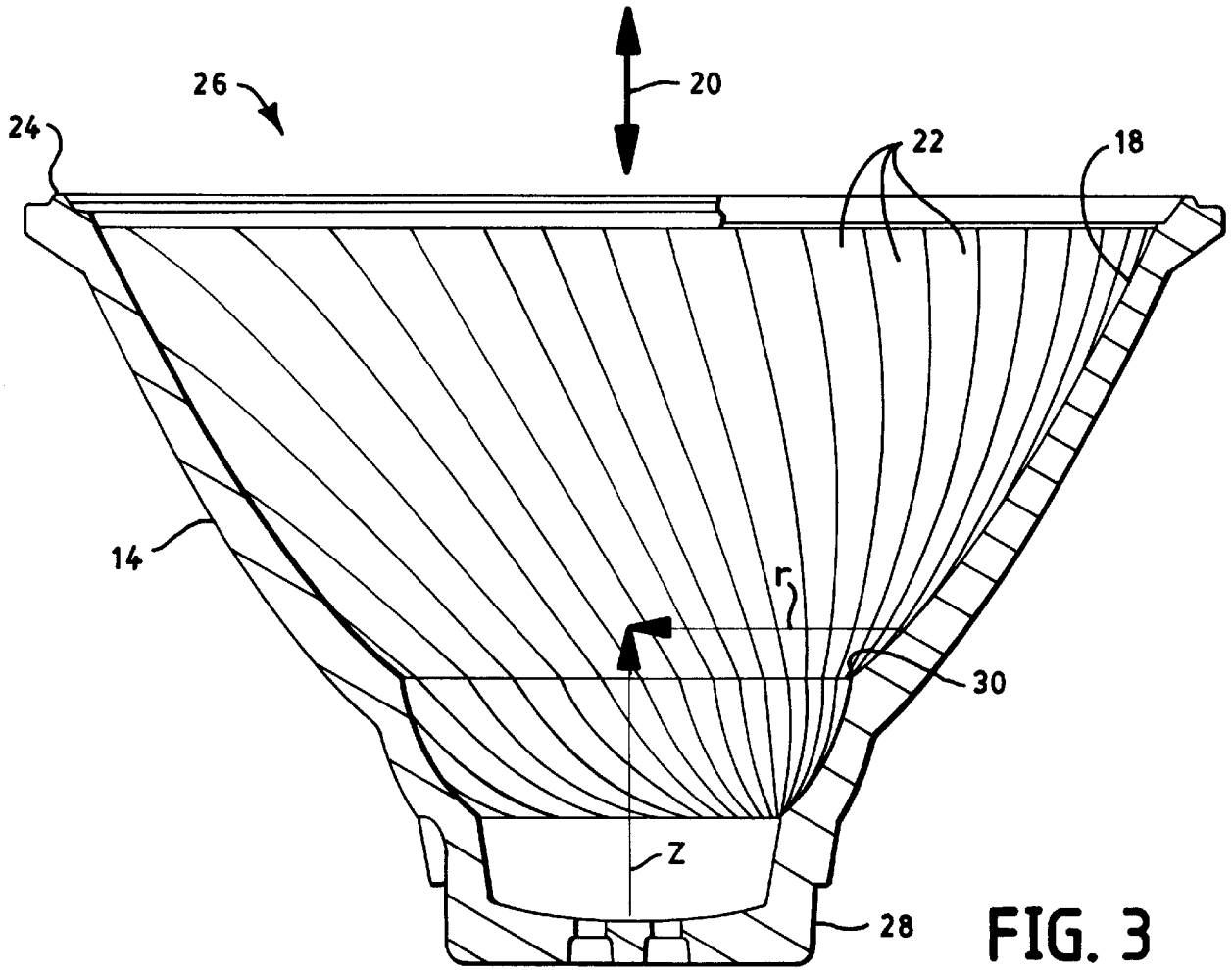
FIG. 3 shows a cross sectional view of a reflector.

FIG. 3 shows a cross sectional view of a reflector 14. The reflector 14 may be made out of molded glass or plastic to have the general form of a cup or hollow shell. The light source 12 is enclosed the reflector 14. The reflector 14 has an interior with a highly reflective inner surface 18. The inner surface 18 of the reflector 14 is generally contoured with one or more sections curved parabolic surface(s) of rotation. The preferred lamp 10 has an axis 20 about which the reflector 14 surface is roughly symmetric. Formed on the reflective inner surface 18, are a plurality of facets 22. The facets 22 may be formed to extend radially (straight sun burst pattern). In the preferred embodiment, the facets at least partially spiral around the lamp axis 20. The reflector 14 cavity has at its forward end a rim 24 defining an opening 26 for the passage of light to the exterior. The preferred a forward opening 26 has a circular form. The reflector 14 may also include a rearward facing neck 28 or similar stem or other support or connection features for electrical and mechanical connection and support.

Figure 4:
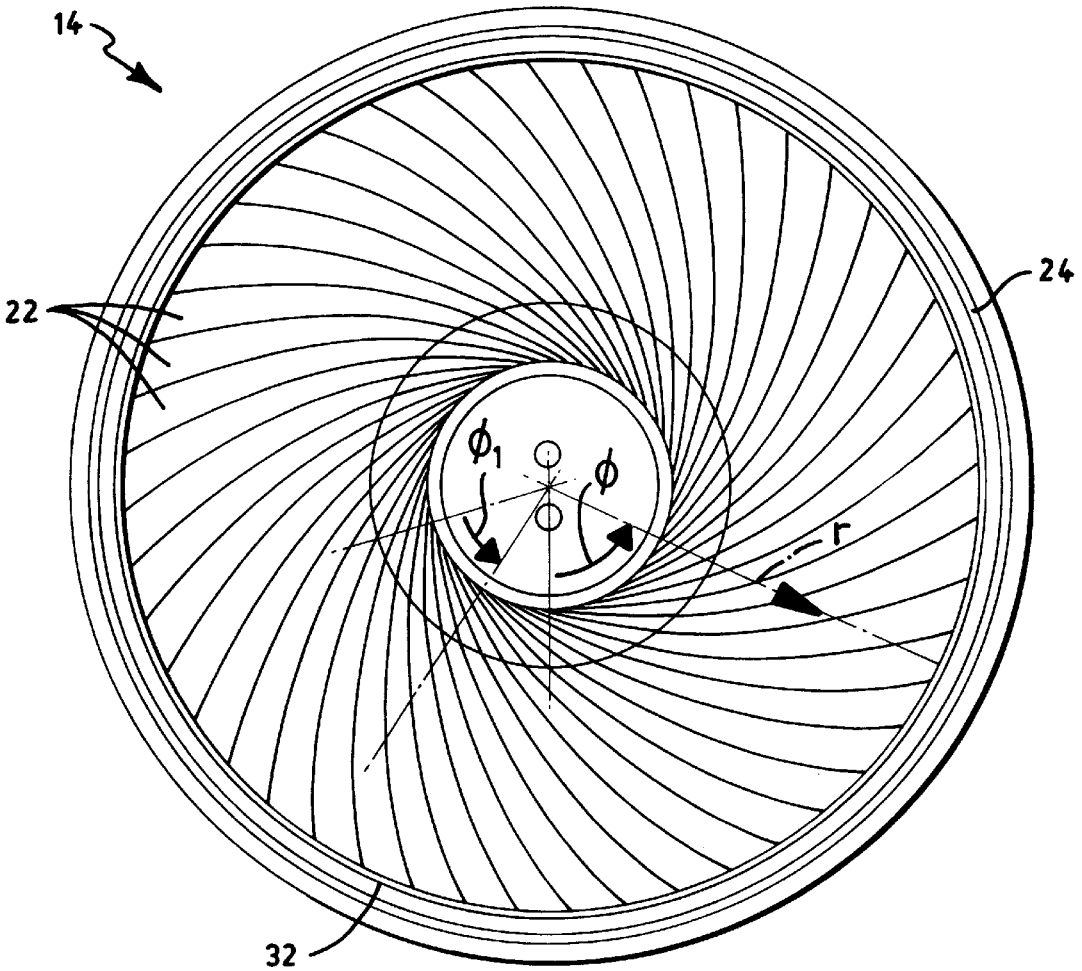
FIG. 4 shows a top view looking into a reflector.

The preferred basic reflector contour is a parabola of rotation. The basic contoured reflector 14 then has an axis 20 or centerline which may be used to described the reflector surface in standard cylindrical coordinates (r, $\phi$, and Z), where r is the radial distance from the axis 20, theta $\phi$ is the angle measurement around the axis 20, and Z is the distance along the axis 20. Additionally, the basic reflective surface is modified to include a multiplicity of facets 22 that may be described with reference to the distance along, from and around the axis 20. The preferred reflector 14 for this combination is a parabolic reflector 14 divided into a number of facets 22 of equal angular widths. Each facet 22 is shown to run from the heel 30 to the rim 24 through a fixed arc $\phi_1$, (e.g. a 45° arc). The preferred rate of rotation is a constant function of Z. The radius of the arc neither increases nor decreases. Therefore, while each spiral facet 22 generally follows the reflector contour (cross section in an axial, medial plane), each facet 22 also "rotates" about the axis 20 with increasing distance along the axis 20 (Z). This is the simplest form of the design. The preferred facet 22 design has a cross section 32 that is straight or flat taken in a plane perpendicular to the axis 20. The cross section of the inner surface 18 is then a regular N sided polygon. FIG. 4 shows an inner surface with 48 flat facets 22, so the axially transverse cross section of the reflector shows a regular 48 sided polygon. A flat facet cross section is the simplest design for tooling manufacture. Alternatively, the facet cross section may be either concave or convex, sinusoidal, pyramidal or any of a variety of other surface deviations that vary the basic facet cross sectional contour. Precaution should be taken not to closely match the facet contour with the original circular cross section, as the facets then merge as smooth reflector. It should be noted that with increasing departure from the circular cross section in the facet, increasing light beam spread is added to the final beam. This beam angle spread is acceptable to a degree, as less lenticular spread is needed to achieve the total desired beam angle. For a flat facet the additional spread occurring at the end of the facet is equal to or less than 180 degrees divided by the number of facets N (e.g. 3.75 degrees for 48 facets). Not all the light is spread from the facet edges, so overall light being spread has spread angles varying smoothly from 0 to 180/N degrees. An average spread value would be 180/2N. The effectiveness of the invention is then strongly influenced by the count N of facets 22 around the reflector 14. A facet count N between approximately 16 and 64 yields in varying degree the desired effect of blurring and blending the source images. For facet count values above 50, with flat facets, the reflective surface 18 increasingly approximates a standard parabola, so the source image blending effect is lost. As the facet count value moves below 30, that facets 30 have increasing divergence from the circular, and therefore increasingly spread the beam. Too much spread can be added to the beam and production of a narrow spot beam then becomes difficult. With the preferred facet count N of 48 the reflector induced beam spread is then from 0 to 3.75 degrees for an average of 1.875 degrees. This has been found to enable commercially acceptable narrow (tight) beams (9 degrees) at one end of the design spectrum, and provide adequate image blending for wide (broad) beams (56 degrees).

Figure 5:
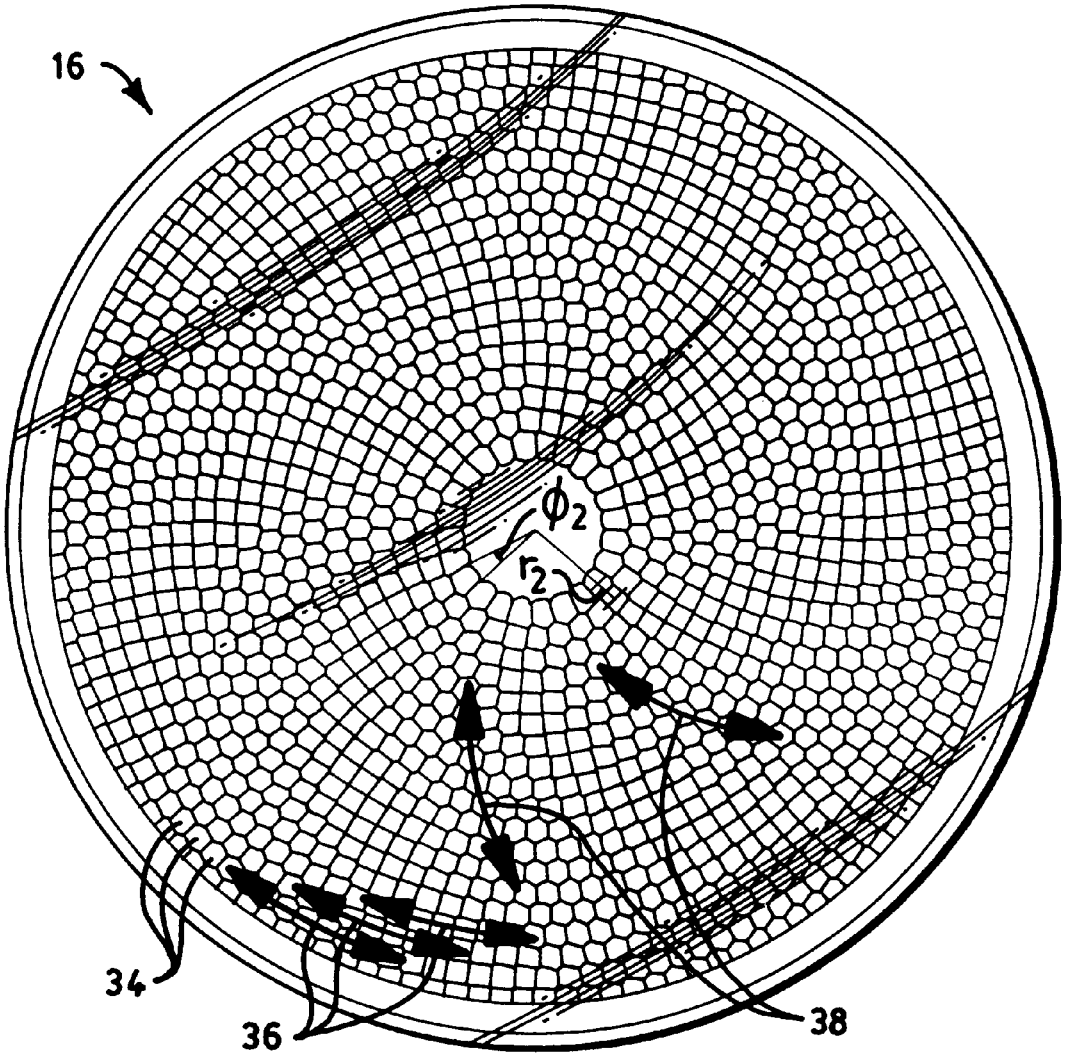
FIG. 5 shows a top view of a lens.

FIG. 5 shows a top view of a lens 16. The preferred lens 16 is made out of molded light transmissive glass although plastic may be used. The lens 16 may have the general form of a disk, or dish with a diameter matched to close with the reflector 14 to seal the reflector 14 opening 26 and thereby enclose the light source 12. The preferred lens 16 may include an exterior rim sealing with the reflector rim 24 to close opening 26. The lens 16 has a multiplicity of lenticules 34 arranged concentric rings 36 to form spiral arms 38 around the axis 20. The preferred lenticule is chosen to provide a beam spread such that the average beam spread from the reflector plus the lenticule spread yields the desire overall lamp beam spread.

The preferred lenticular array has a polar array of lenticules positioned in rings around the center of the lens 16. Each ring of lenticules consists of an increasing number of lenticules, sufficient to eliminate open spaces between lenticules in the same ring. Similarly, adjacent rings of lenticules are sufficiently radially close to eliminate spaces between the adjacent rings. The starting point of each successive concentric lenticule ring 36 is then offset by a constant distance $r_2$ along the radius as well as by a constant angular offset $\phi_2$ The offsets ($r_2$, $\phi_2$) then defeat the occurrence of linear arrays of lenticules or junctions between lenticules that lead to overlapping deflections in beam segments that lead to light or dark streaks. Various degrees of angular offset $\phi_2$ have been tried, and it was found that 2° looks best. In the preferred embodiment each ring 36 includes an integral multiple of a base number M of lenticules. The base number M of lenticules used in FIG. 5 is six, so the lenticule count in each successive row increases by six. In theory, any base number M of lenticules greater than two lenticules could work to produce a spiral pattern some degree. In practice, a base number of five appears to be the practical minimum. With relatively fewer lenticules in the base number M, the lenticules are relatively larger, providing good individual source image dispersion, but groupwise the spiral arm pattern is crudely defined and there is poor overlaying of multiple source images, thereby resulting in a streaky or patchy pattern. Also with larger lenticules, a single lenticule may span the whole spread angle provided by the reflector spread, with the result that whole spread image from a facet is projected as a whole by a single lenticule. The maximum base number M is poorly defined, but is believed to be less than twenty. With an increasing base number M, the lenticules become relatively smaller. There is relatively less individual image dispersion, even though the spiral arm count, which is the same as M, increases and the pattern becomes more refined leading to multiple overlaying source images. The result, in the extreme, are undispersed source images that are closely overlaid. The lenticule 34 size and the spiral arm count then need to be balanced one against the other.

The faceted reflector 14 design slightly de-collimates (spreads) the light before it encounters the lens 16. This slight de-collimation changes the slope of the light intensity curve around the beam edge. The intensity change is no longer so sharp as to be perceived as an edge by the human eye, and as a result the illusory light and dark ring effect is reduced or eliminated. The reflector and lens combination also effectively de-collimates the beam enough to hide flaws in the lens 16 without sacrificing the efficiency of the parabolic form. Another beneficial effect of the invention is color blending in lamps that use coated capsules. The lamp then gives the perception of a round beam with a smooth edge, even light, and with no or very little illusory dark or light rings.

In a working example some of the dimensions were approximately as follows: The light source was made of tungsten halogen or arc discharge, but any compact, electric is acceptable. The reflector was made of molded glass, and had a interior, reflective surface with 48 flat facets formed equiangularly on the interior wall. The 48 facets spiraled around the axis through an angle of 45 degrees. The reflector had an outside depth of 7.63 centimeters (3 inches), and outside diameter of 12.19 centimeters (4.8 inches). The lens was made of molded light transmissive glass, and had lenticules arranged in 19 concentric rings. There were 24 lenticules in the inner most ring, and the lenticule count increase by 6 with each successive ring 36 for a total of 1482 lenticules. Each ring of lenticules was offset ($\phi_2$) by about 2 degrees with respect to the lenticules in the adjacent ring, thereby resulting in spirals patterns being formed that extended from the lens center to the rim of the lens with about a 45 degree rotation around the axis.

Figure 6:
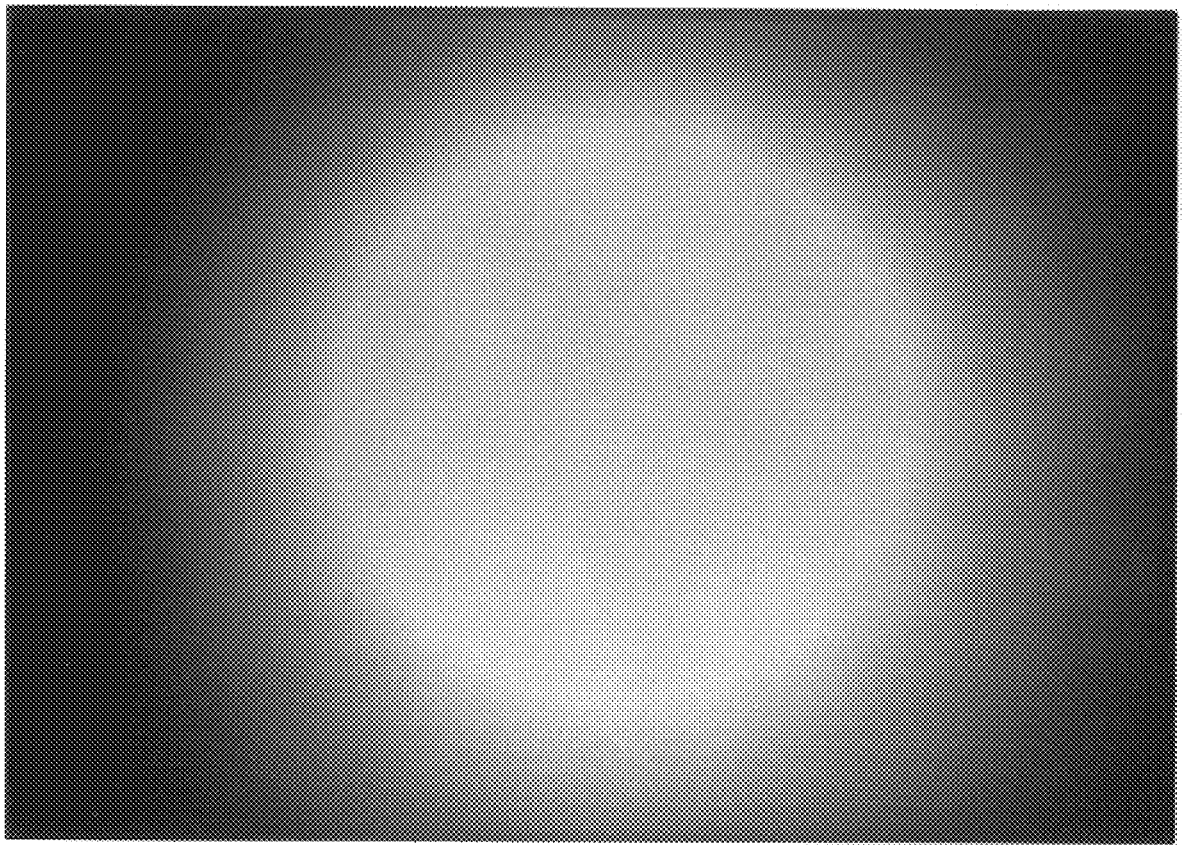
FIG. 6 shows a beam pattern from the spiral reflector, and spiral lens PAR lamp.

With the above working example, a lamp was constructed and the beam shone on a wall. FIG. 6 depicts the resulting beam results, as taken from a video scanned image. It can be seen that there is an brightly lit central disk that is evenly lit. The edge of the disk is nearly exactly circular, with any source images being blurred. The exterior region is similarly smoothly lit in patterning with a rapid drop off in intensity. (There are some digitization effects in the shading.) The actual spot appears equally good if not better to the human eye. In short a high quality round spot has been produced. The disclosed dimensions, configurations and embodiments are as examples only, and other suitable configurations and relations may be used to implement the invention.

What is claimed is:

1. A reflector lamp providing an improved beam pattern comprising:

a) an electric light source, b) a reflector with a wall defining a cavity, an axis, and a rim defining an opening, the light source being positioned in the cavity between the wall and the opening along the axis, the wall further having a reflective surface facing the light source shaped and positioned with respect to the light source to provide a beam of light, the reflective surface including a number of facets positioned around the axis whereby a cross section perpendicular to the axis through the facets provides N facet sections, wherein N is equal to or greater than 16 and less than or equal to 64, and c) a lens formed as a light transmissive plate shaped to mate with the reflector along the rim, the lens having a multiplicity lenticules distributed thereon, the lenticules positioned to form a plural number of M spiral arm patterns extending from the lens center to the lens rim, wherein N is greater than M.

2. The lamp in claim 1, wherein the number of facets is equal to or greater than 32 and equal to or less than 56.

3. The lamp in claim 1, wherein the number of facets is equal to 48.

4. The lamp in claim 1, wherein the number of spiral arm patterns is equal to or greater than 5 and equal to or less than 20.

5. The lamp in claim 1, wherein the number of spiral arm patterns is equal to 6.

6. A reflector lamp providing an improved beam pattern comprising:

a) an electric light source, b) a reflector with a wall defining a cavity and an axis, a rim defining an opening, the light source being positioned in the cavity between the wall and the opening along the axis, the wall further having a reflective surface facing the light source shaped and positioned with respect to the light source to provide a beam from regions of the reflector adjacent the reflector have a plural number N of facets spiraling around the axis, while extending from the reflector interior to the reflector rim, whereby the spiral facets cause a radial repetition of N source images around the axis, and c) a lens formed as a light transmissive plate shaped to mate with the reflector along the rim, the lens having a multiplicity lenticules distributed thereon, the lenticules positioned to form a plural number of spiral arm patterns extending from the lens center to the lens rim, wherein each lenticule has a spread angle of more than N degrees.

7. A lamp with a faceted reflector and a spiral lens comprising:

a) a compact electric light source, b) a reflector, having a wall defining a cavity with an axis and an interior reflective surface, and a forward opening, the wall substantially surrounding and enclosing the light source with respect to the forward opening, a plurality of facets formed on the interior wall, the facets at least partially spiraling around the axis, the reflector further including a mechanical coupling to support the reflector in a lamp fixture and an electrical coupling to supply electric power to the light source, c) a lens, coupled to the reflector along the forward opening enclosing the cavity, the lens having a multiplicity of lenticules arranged in spirals around the axis, and an exterior rim sealing with the reflector opening.

* * * * *